US010989440B2

(12) United States Patent
Fujiwara et al.

(10) Patent No.: US 10,989,440 B2
(45) Date of Patent: Apr. 27, 2021

(54) AIR-CONDITIONING APPARATUS

(71) Applicant: Mitsubishi Electric Corporation, Tokyo (JP)

(72) Inventors: Susumu Fujiwara, Tokyo (JP); Kazuki Isomura, Tokyo (JP); Masahiko Takagi, Tokyo (JP); Makoto Kurihara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 45 days.

(21) Appl. No.: 16/333,806

(22) PCT Filed: Dec. 19, 2016

(86) PCT No.: PCT/JP2016/087762
§ 371 (c)(1),
(2) Date: Mar. 15, 2019

(87) PCT Pub. No.: WO2018/116340
PCT Pub. Date: Jun. 28, 2018

(65) Prior Publication Data

US 2020/0072495 A1 Mar. 5, 2020

(51) Int. Cl.
*F04D 29/66* (2006.01)
*F24F 13/24* (2006.01)
*F24F 1/0029* (2019.01)

(52) U.S. Cl.
CPC ..... *F24F 13/24* (2013.01); *F04D 29/664* (2013.01); *F24F 1/0029* (2013.01)

(58) Field of Classification Search
CPC .... F24F 13/24; F24F 1/0029; F24F 2013/242; F24F 2013/245; F24F 13/081;
(Continued)

(56) References Cited

U.S. PATENT DOCUMENTS 7,883,312 B2 * 2/2011 Eguchi ..... F04D 29/162 415/119
9,145,900 B2 * 9/2015 Kim ..... F04D 29/4233
(Continued)

FOREIGN PATENT DOCUMENTS

CN 1336482 A 2/2002
CN 1678842 A 10/2005
(Continued)

OTHER PUBLICATIONS

English Machine translation of JP2013228168, Oct. 19, 2020.*
(Continued)

*Primary Examiner* — Christopher Verdier
*Assistant Examiner* — Sabbir Hasan
(74) *Attorney, Agent, or Firm* — Posz Law Group, PLC

(57) ABSTRACT

An air-conditioning apparatus includes a housing having an air inlet and an air outlet, a fan disposed in the housing, and a bell mouth through which a fluid flowing from the air inlet to the air outlet passes in association with rotation of the fan. The bell mouth includes curved part having a curved sectional shape in a fluid flow direction and a vibration-damping element disposed on at least one of a front surface and a rear surface of the curved part. The vibration-damping element is disposed at a position corresponding to a node of vibration of the bell mouth.

5 Claims, 6 Drawing Sheets

(58) Field of Classification Search
CPC .... F04D 29/664; F04D 29/441; F04D 29/668; G10K 11/161
See application file for complete search history.

(56) References Cited

U.S. PATENT DOCUMENTS

| | | | |
|---|---|---|---|
| 2002/0015640 | A1 | 2/2002 | Nishiyama et al. |
| 2005/0223732 | A1 | 10/2005 | Kim et al. |
| 2010/0218403 | A1 | 9/2010 | Imamura et al. |
| 2011/0002775 | A1 | 1/2011 | Ma et al. |

FOREIGN PATENT DOCUMENTS

| | | | | |
|---|---|---|---|---|
| CN | 1680753 | A | | 10/2005 |
| JP | 2009-264121 | A | | 11/2009 |
| JP | 2010-127594 | A | | 6/2010 |
| JP | 2012-207643 | A | | 10/2012 |
| JP | 2013-228168 | A | | 11/2013 |
| JP | 2013228168 | A | * | 11/2013 |

OTHER PUBLICATIONS

Office Action dated Jun. 28, 2020 issued in corresponding CN patent application No. 201680090678.0 (and English translation).
International Search Report of the International Searching Authority dated Feb. 28, 2017 for the corresponding international application No. PCT/JP2016/087762 (and English translation).
Extended European Search Report dated Nov. 8, 2019 issued in corresponding European patent application No. 16924821.8.
Office Action dated Feb. 10, 2021 issued in corresponding CN patent application No. 201680090678.0 (and English machine translation).

* cited by examiner (a)

(b)

(a)

(b)

(c)

(a)

(b)

(c)

AIR-CONDITIONING APPARATUS

CROSS REFERENCE TO RELATED APPLICATION

This application is a U.S. national stage application of PCT/JP2016/087762 filed on Dec. 19, 2016, the contents of which are incorporated herein by reference.

TECHNICAL FIELD

The present invention relates to air-conditioning apparatuses including air passages through which air flows, and in particular, relates to an air-conditioning apparatus including a housing structure that achieves reduction of housing-vibration-induced sound resulting from rotation of a fan.

BACKGROUND ART

For example, as described in Patent Literature 1, there has been a method for reducing noise in a centrifugal air-sending device. To reduce noise of, for example, vibration resulting from rotation of a fan, this method includes reducing a frequency that contributes to noise by providing a resonant space in proximity to an air inlet of a bell mouth.

Furthermore, as described in Patent Literature 2, there has been an air-conditioning-apparatus outdoor unit including a bell mouth having ribs (strengthening ribs 53) arranged at predetermined positions on a rear surface of the bell mouth to reduce vibration of the bell mouth caused by a fluid flowing through the bell mouth.

CITATION LIST

Patent Literature

Patent Literature 1: Japanese Unexamined Patent Application Publication No. 2009-264121

Patent Literature 2: Japanese Unexamined Patent Application Publication No. 2010-127594

SUMMARY OF INVENTION

Technical Problem

In the related art described in Patent Literature 1, the resonant space is provided at a rear of the bell mouth. Disadvantageously, a fluid flowing at the rear of the bell mouth may create turbulence in the resonant space, causing generation of new vibration-induced sound (noise).

In the related art described in Patent Literature 2, many ribs are arranged at predetermined intervals in a circumferential direction. For resonant vibration propagating from a housing, however, the ribs may not be arranged at suitable positions for reducing vibration resulting from resonance. Some ribs are of little or no use in reducing vibration resulting from, for example, resonance. Furthermore, the ribs may create new vibration by themselves, causing generation of new vibration-induced sound.

Noise includes not only sound of a fluid through a fan but also resonance sound of a structure having an air passage and housing-vibration-induced sound of a structure. The resonance sound of a structure having an air passage and the housing-vibration-induced sound of a structure are in form of noise that has a plurality of characteristic peak frequencies and is unpleasant to hear.

In particular, rotation of a device, for example, a fan, generates sound (typically referred to as NZ sound) having a frequency characteristic obtained by multiplying a rotation period (N) by the number of blades (Z). As such sound, sound resulting from a fluid passing through a fan is known. Surprisingly, however, it is relatively unknown that noise includes not only the above-described sounds but also sound resulting from vibration of a housing vibrated by a fluid passing through the housing.

Such vibration can include a vibration component resulting from fluid-induced vibration of a housing, a vibration component propagated to the housing, serving as a structure, from, for example, a motor to which a fan is connected and fixed, and a vibration component resulting from resonance with natural vibration of the housing structure. It has been found that resonance with natural vibration of the housing structure can cause resonance sound to be generated from unexpected part of the housing structure and such resonance sound becomes a problem.

The present invention has been made in view of the above-described problems, and aims to provide an air-conditioning apparatus in which a countermeasure against vibration-induced sound resulting from vibration of a housing is adopted and in which unpleasant sound having a peak frequency of the vibration-induced sound resulting from vibration of the housing is attenuated without obstruction to fluid flow.

Solution to Problem

An air-conditioning apparatus according to an embodiment of the present invention includes a housing having an air inlet and an air outlet, a fan disposed in the housing, and a bell mouth through which a fluid flowing from the air inlet to the air outlet passes in association with rotation of the fan. The bell mouth includes curved part having a curved sectional shape in a fluid flow direction and a vibration-damping element disposed on at least one of a front surface and a rear surface of the curved part. The vibration-damping element is disposed at a position corresponding to a node of vibration of the bell mouth.

Advantageous Effects of Invention

As the vibration-damping element is disposed at the position corresponding to a node of a vibration mode of the bell mouth on at least one of the rear surface and the front surface of the curved part of the bell mouth, the air-conditioning apparatus according to an embodiment of the present invention can reduce or eliminate divided vibration of the bell mouth caused by rotation of the fan, thus effectively attenuating a peak frequency of NZ sound generated by vibration of the bell mouth.

DESCRIPTION OF EMBODIMENTS

Figure 1:
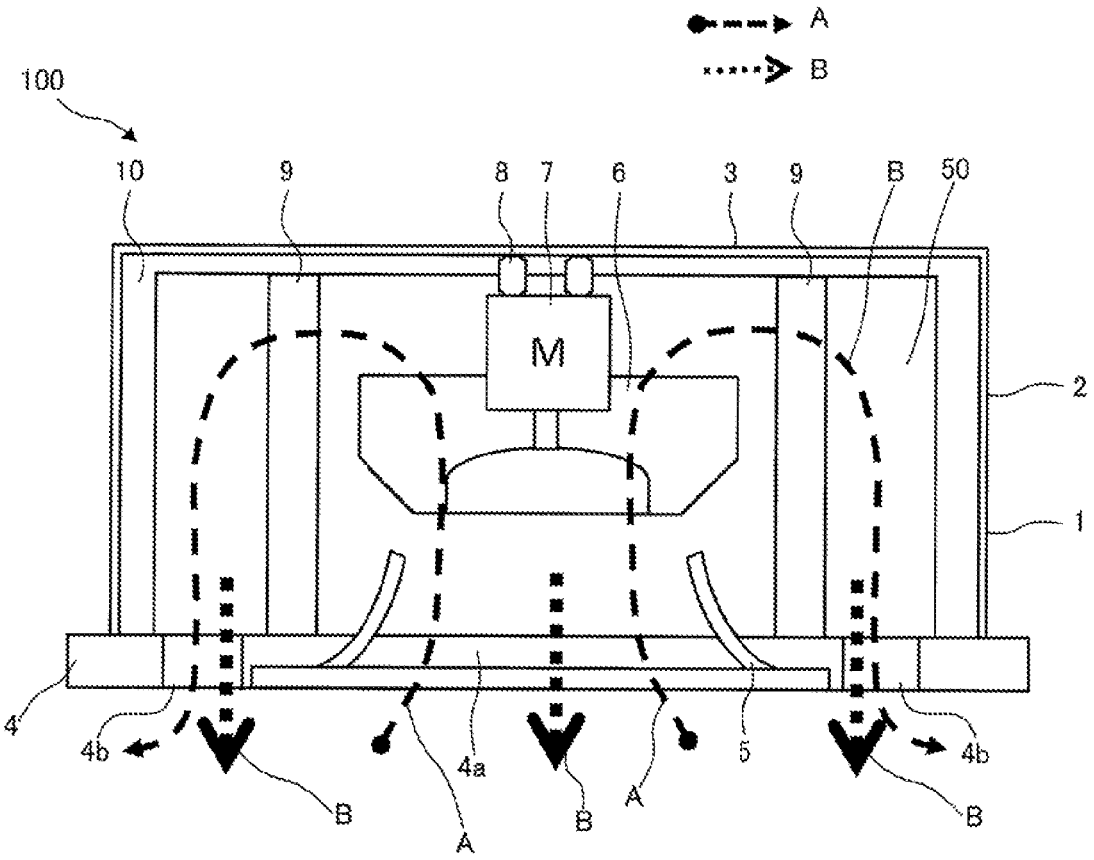
FIG. 1 is a schematic side view illustrating a schematic exemplary configuration of an air-conditioning apparatus according to Embodiment of the present invention as viewed from a side of the air-conditioning apparatus.

Embodiment of the present invention will be described with reference to the drawings. Note that the relationship between the sizes of components illustrated in the following drawings including FIG. 1 may differ from that of actual ones. Furthermore, note that components designated by the same reference signs in the following drawings including FIG. 1 are the same components or equivalents. This note applies to the entire description herein. In addition, note that the forms of components described herein are intended to be illustrative only and the forms of the components are not intended to be limited to those described herein.

FIG. 1 is a schematic side view illustrating an exemplary schematic configuration of an air-conditioning apparatus 100 according to Embodiment of the present invention as viewed from a side of the air-conditioning apparatus 100. The air-conditioning apparatus 100 will be described below with reference to FIG. 1. In FIG. 1, dotted-line arrows A represent air flow and dotted-line arrows B represent sound flow.

The air-conditioning apparatus 100 has functions of an indoor unit installed in an indoor space (air-conditioned space) in, for example, a house, a building, or an apartment, and supplies conditioned air to the air-conditioned space by using a refrigeration cycle. Although the air-conditioning apparatus 100 of a ceiling embedded type will be described herein as an example, the type of the air-conditioning apparatus 100 is not limited to this example. The present invention is applicable to any type of air-conditioning apparatus, for example, a ceiling suspended type, a wall hung type, or a floor standing type.

The air-conditioning apparatus 100 includes a housing 1 accommodating an air passage 50 through which the air is circulated.

The air-conditioning apparatus 100 further includes a motor 7 suspended from substantially central part of an inner upper surface of the housing 1, a fan 6 attached to a shaft of the motor 7, and a heat exchanger 9 disposed around the fan 6. The air-conditioning apparatus 100 further includes a front panel 4 attached to lower part of the housing 1.

The housing 1 is box-shaped and has an open bottom, sides 2, and a top 3. The housing 1, serving as a body of the air-conditioning apparatus 100, accommodates the motor 7, the fan 6, and the heat exchanger 9. The housing 1 further accommodates the air passage 50 through which the air is circulated. Driving the fan 6 circulates the air through the air passage 50 (as represented by the dotted-line arrows A).

In addition, a foam material 10 is disposed at an interior of the sides 2 and the top 3 of the housing 1. A wall may be interposed between the foam material 10 and the air passage 50.

The motor 7 is suspended from the housing 1 by support rubber 8 in such a manner that the shaft of the motor extends downward, and rotates the fan 6. Specifically, the support rubber 8 is fastened to the inner surface of the top 3 of the housing 1, and the motor 7 is fastened to the support rubber 8.

The fan 6 is fastened to the shaft of the motor 7 in such a manner that an air inlet of the fan faces downward. The fan 6 suctions the air from the air-conditioned space, such as an indoor space where the air-conditioning apparatus 100 is installed, allows the air to pass through the heat exchanger 9, and blows the air into the air-conditioned space.

The front panel 4 has an air inlet 4*a* through which the air is suctioned into the housing 1 and an air outlet 4*b* through which the air is discharged out of the housing 1. The air inlet 4*a* is open and located at central part of the housing 1 in plan view. The air outlet 4*b* is open and located around the air inlet 4*a*. A bell mouth 5 is disposed at the air inlet 4*a*. The bell mouth 5 regulates the flow of the air suctioned from the air-conditioned space into the housing 1 to reduce or eliminate noise and thus reduce or eliminate a degradation in user comfort.

The heat exchanger 9 acts as a condenser in a heating operation, acts as an evaporator in a cooling operation, and exchanges heat between the air supplied from the fan 6 and a heat medium, such as refrigerant, supplied from a heat source unit (outdoor unit), which is not illustrated, to produce heating air or cooling air.

The air passage 50 is provided inside the housing 1 in such a manner that the air inlet 4*a* communicates with the air outlet 4*b*. In the air passage 50, the air suctioned from the air-conditioned space through the air inlet 4*a* flows through the fan 6, the inside of the heat exchanger 9, the outside of the heat exchanger 9, and the air outlet 4*b* in the stated order.

A grille having a plurality of openings through which the air to be suctioned into the housing 1 passes and an air filter for removing dust contained in the air are preferably arranged at the air inlet 4*a* of the front panel 4 in such a manner that the air filter is located above the grille.

A vertical air-directing vane for adjusting a blowing direction in which the air is blown is typically disposed at the air outlet 4*b* of the front panel 4.

Furthermore, the front panel 4 is disposed in such a manner that, for example, a lower surface of the front panel 4 is substantially flush with a ceiling to which the front panel 4 is installed.

<Housing-Vibration-Induced Sound Resulting from Rotation of Fan>

As sound that is generated in a device including a fan, sound resulting from a fluid passing through the fan is known. Surprisingly, it is relatively unknown that examples of the sound that is generated in a device including a fan further include sound resulting from vibration of a housing, or housing-vibration-induced sound. It has been found that housing-vibration-induced sound includes a vibration-induced sound component resulting from fluid-induced vibration of a housing, a vibration-induced sound component propagated to the housing, serving as a structure, from, for example, a motor to which a fan is connected and fixed, and resonance sound that results from resonance with natural vibration of the housing structure and that is generated from unexpected part of the housing structure.

Like the air passage 50 in the air-conditioning apparatus 100, a sound propagation path in a device including a fan may be defined by, for example, a heat-insulating foam material. The foam material may be vibrated by a fluid or may resonate with vibration associated with rotation of a motor or a fan, propagate the vibration through the structure, and thus generate "vibration". The "vibration" generated by the foam material may be propagated to components constituting the device including the fan, thus forcibly vibrating the components or causing resonance-induced vibration of the components. This action results in noise unpleasant to hear.

This noise results from vibration of the components constituting the device. Specifically, rotation of the fan generates NZ sound. The NZ sound directly vibrates an air passage structure, resulting in vibration of a bell mouth disposed at an air inlet. The NZ sound is obtained by multiplying a rotation period (N) of the fan by the number (Z) of blades. Such a phenomenon can similarly occur in the air-conditioning apparatus 100.

A typical bell mouth (including the bell mouth 5), which serves as an air passage, has a curved vertical section not to obstruct air flow. Vibration associated with rotation of a fan can be propagated to the bell mouth having such a structure through a housing structure. The bell mouth has one end coupled to the housing and is thus inevitably included in a vibration propagation path. Propagation of the vibration associated with the rotation of the fan to the bell mouth causes a divided vibration mode in which a first "antinode (+)", a "node", and another "antinode (−)" appear in parts of the bell mouth included in the vibration propagation path. This vibration mode has a feature in which the amplitude of vibration of part close to the housing is larger than that of part remote from the housing.

Figure 2A:
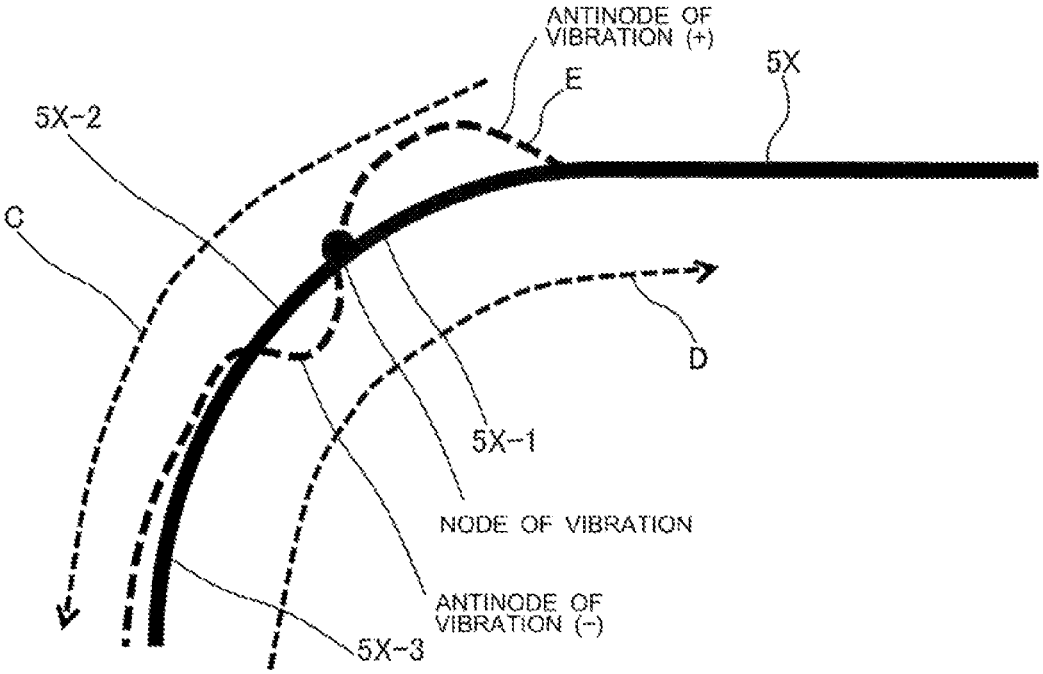
FIG. 2A is a schematic diagram explaining a vibration state of a bell mouth.
Figure 2B:
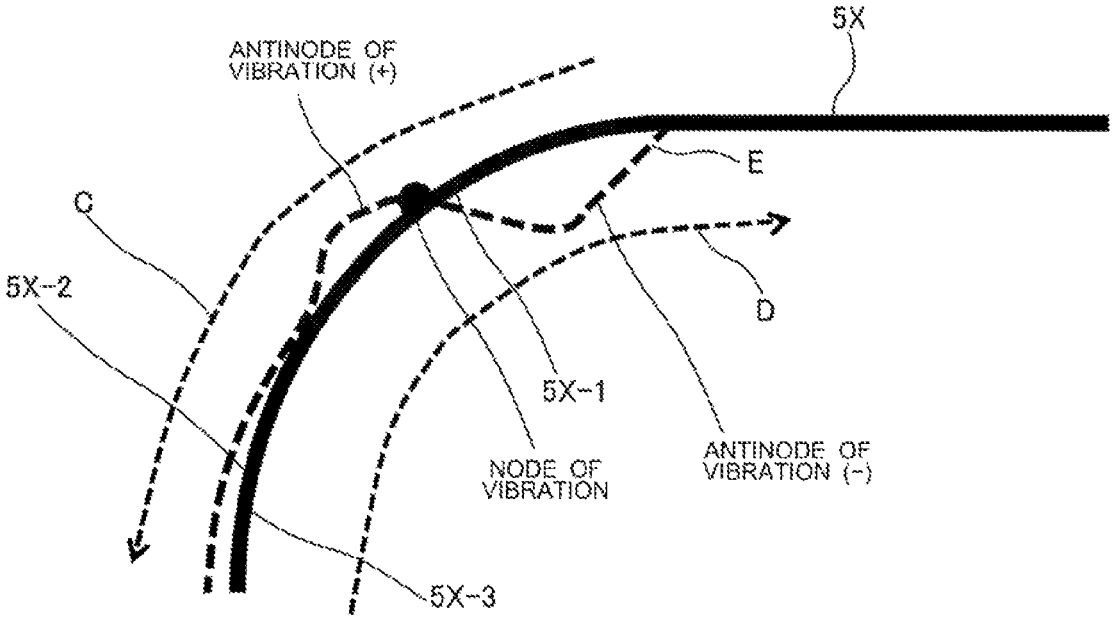
FIG. 2B is a schematic diagram explaining another vibration state of the bell mouth.

The bell mouth has vibration states as illustrated in FIGS. 2A and 2B. FIGS. 2A and 2B are schematic diagrams explaining the vibration states of the bell mouth. In FIGS. 2A and 2B, the bell mouth is illustrated as a "bell mouth 5X", curved part is illustrated as "curved part 5X-1", a front surface of the bell mouth is illustrated as a "bell-mouth front surface 5X-2", and a rear surface of the bell mouth is illustrated as a "bell-mouth rear surface 5X-3". In FIGS. 2A and 2B, arrows C represent flow of a fluid (air) in a partition close to the bell-mouth front surface 5X-2, and arrows D represent flow of the fluid (air) in a partition close to the bell-mouth rear surface 5X-3. Furthermore, dotted lines E represent vibration states of the bell mouth 5X.

FIG. 2A illustrates a vibration state in a divided vibration mode in which a first "antinode (+)", a "node", and a second "antinode (−)" appear in parts of the bell mouth included in a vibration propagation path, as represented by the dotted line E.

FIG. 2B illustrates a vibration state in a divided vibration mode in which a first "antinode (−)", a "node", and a second "antinode (+)" appear in parts of the bell mouth included in a vibration propagation path, as represented by the dotted line E.

These figures demonstrate that reducing or eliminating vibration of the bell mouth 5X is an effective countermeasure against the NZ sound and this countermeasure differs from a countermeasure against fluid-induced vibration from a fan.

As the bell mouth 5X serves as an air passage, bumps, such as ribs, on the bell-mouth front surface 5X-2 and the bell-mouth rear surface 5X-3 interfere with fluid flow, or generate new sound associated with a fluid. As even merely forming a rib having a simple shape causes the same problem, care must be taken in providing bumps.

<Measures to Reduce or Eliminate Vibration of Bell Mouth>

Examples of measures to reduce or eliminate vibration of a bell mouth, or countermeasures against the NZ sound, include the following three measures:

First measure including performing a vibration-damping process on the bell mouth, serving as an air flow passage;

Second measure including performing a vibration attenuation process on a vibration propagation path including a housing and the bell mouth; and Third measure including adopting a countermeasure against vibration to make a bell mouth body.

The first measure is intended to increase the stiffness of the bell mouth. This measure includes structurally processing the bell mouth to reduce or eliminate vibration of the bell mouth. Specifically, the measure includes allowing the bell mouth to have a rib having a specific shape in such a manner that the rib does not obstruct the air passage.

The second measure is intended to attenuate vibration of the bell mouth. This measure includes fixing a vibration-to-heat transforming unit (vibration-damping element) to the bell mouth. Specifically, the measure includes bonding a vibration-damping element to the bell mouth or applying vibration-damping paint to the bell mouth.

The third measure is intended to damp vibration of the bell mouth by using a material for the bell mouth. This measure includes forming a material containing a vibration-damping material into the bell mouth. Specifically, the measure includes molding the bell mouth from vibration-damping resin.

Adopting such a measure enables control in the propagation path to achieve overall reduction or elimination of vibration, and ensures attenuation of the NZ sound having a characteristic peak frequency.

(Example of First Measure)

Figure 3:
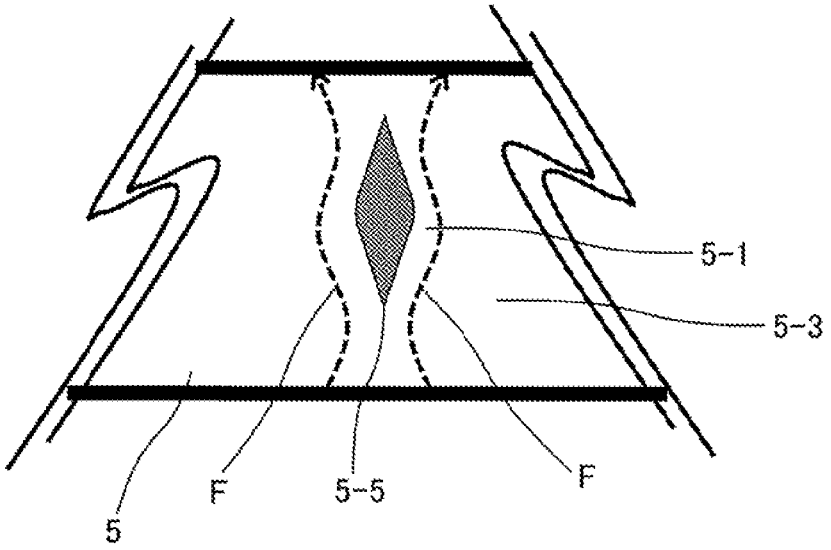
FIG. 3 includes diagrams explaining an example of a first measure to reduce or eliminate vibration of the bell mouth in the air-conditioning apparatus according to Embodiment of the present invention.
Figure 3:
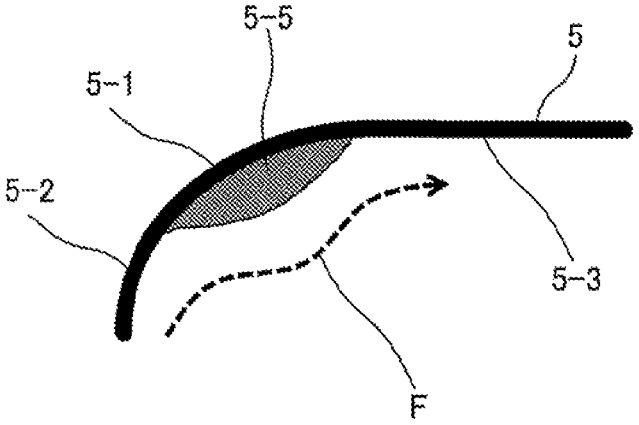

FIG. 3 includes diagrams explaining an example of the first measure to reduce or eliminate vibration of the bell mouth 5 in the air-conditioning apparatus 100. FIG. 3 illustrates curved part of the bell mouth 5 as "curved part 5-1", a front surface of the bell mouth 5 as a "bell-mouth front surface 5-2", and a rear surface of the bell mouth 5 as a "bell-mouth rear surface 5-3". In FIG. 3, arrows F represent flow of a fluid (air). FIG. 3(*a*) schematically illustrates the bell-mouth rear surface 5-3 of the curved part 5-1 and FIG. 3(*b*) schematically illustrates a section of the curved part 5-1 of the bell mouth 5.

As illustrated in FIG. 3, in this example of the first measure, a rib 5-5, serving as a vibration-damping element, is disposed on the bell-mouth rear surface 5-3 of the bell mouth 5 to structurally increase the stiffness of the bell mouth 5. The rib 5-5 has a specific shape not to obstruct the air passage. The rib 5-5 is disposed at a position corresponding to a node of the vibration mode of the bell mouth 5.

Specifically, the rib 5-5 has a mound-like sectional shape having a tip located at the node of the vibration mode (refer to FIG. 3(*b*)). The rib 5-5 has a rhombus shape in plan view (refer to FIG. 3(*a*)). In other words, the rib 5-5 is molded to have a shape having a longitudinal length in an air flow direction. The rib 5-5 has a rounded tip having an angle R of 100 degrees or more.

Such a shape reduces or eliminates secondary vibration of the rib 5-5 and allows the fluid to smoothly flow without being obstructed by the rib 5-5.

It is only required that at least one rib 5-5 is disposed on the curved part 5-1. Any number of ribs 5-5 may be arranged. The rib 5-5 and the bell mouth 5 may be molded in one piece. The rib 5-5 may be molded as a separate piece and be attached to the bell mouth 5.

The rib 5-5 may be molded out of the same material as that for the bell mouth 5. Alternatively, the rib 5-5 may be molded out of a vibration-damping material capable of transforming vibration into heat. Molding the rib 5-5 out of such a vibration-damping material provides greater vibration attenuating effects.

(Example of Second Measure)

Figure 4:
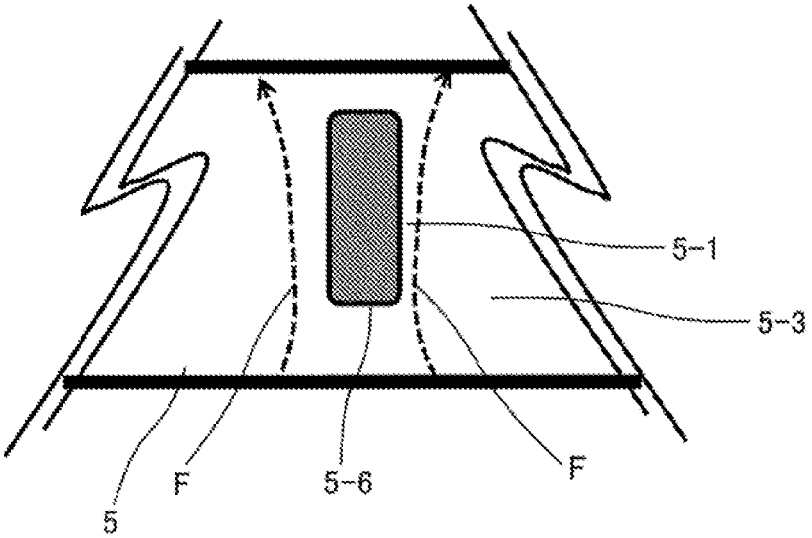
FIG. 4 includes diagrams explaining an example of a second measure to reduce or eliminate vibration of the bell mouth in the air-conditioning apparatus according to Embodiment of the present invention.
Figure 4:
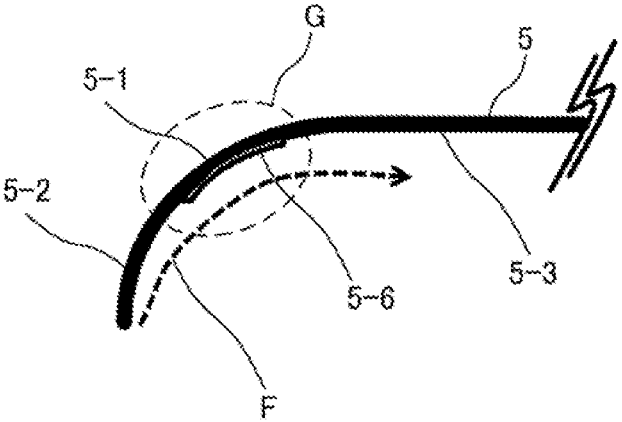
Figure 4:
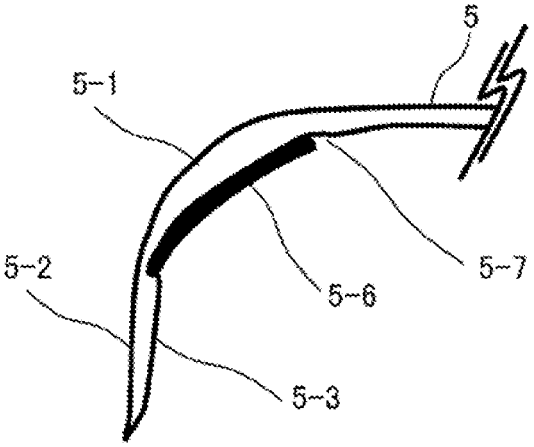

FIG. 4 includes diagrams explaining an example of the second measure to reduce or eliminate vibration of the bell mouth 5 in the air-conditioning apparatus 100. FIG. 4 illustrates the "curved part 5-1", the "bell-mouth front surface 5-2", and the "bell-mouth rear surface 5-3", as in FIG. 3. In FIG. 4, arrows F represent flow of a fluid (air), as in FIG. 3. FIG. 4(*a*) schematically illustrates the bell-mouth rear surface 5-3 of the curved part 5-1, FIG. 4(*b*) schematically illustrates a section of the curved part 5-1 of the bell mouth 5, and FIG. 4(*c*) is a schematic enlarged view of part G in FIG. 4(*b*).

As illustrated in FIG. 4, in this example of the second measure, a sheet-like vibration damper 5-6, serving as a vibration-damping element, is bonded to the bell-mouth rear surface 5-3 of the bell mouth 5. The vibration damper 5-6 is made of a material capable of transforming vibration into heat. Examples of the material for the vibration damper 5-6 include a mixture containing, as a base material, carbon or polyester-based resin, which tends to thermally expand. The vibration damper 5-6 may have any thickness. The vibration damper 5-6 having a thickness of, for example, approximately 2 mm is preferably formed.

Furthermore, a recess 5-7 having a predetermined depth is formed not to obstruct the air passage, and the vibration damper 5-6 is attached to the recess 5-7. Specifically, the recess 5-7 is formed in part that is subjected to the vibration mode of the bell mouth 5, or in an area extending from part in proximity to the fixed end of the bell mouth 5 (or the lower end of the bell mouth 5 in FIG. 1) to middle part of the curved part 5-1, and is formed to have a depth in such a manner that the vibration damper 5-6 is received in and bonded to the recess 5-7. For example, the depth of the recess 5-7 preferably include the thickness of the vibration damper 5-6 and the thickness of a bonding layer, or is preferably the thickness obtained by adding a little extra thickness to 2 mm so that the vibration damper 5-6 can be fully inserted into the recess 5-7 to obtain a flat surface to which the vibration damper 5-6 is bonded. Consequently, it is only required that the depth of the recess 5-7 is determined depending on the thickness of the vibration damper 5-6.

Consequently, the bell-mouth rear surface 5-3 has no protrusion, such as a rib, so that the fluid flowing on the bell mouth 5 is not obstructed. Vibration in the divided vibration mode in the curved part 5-1 of the bell mouth 5 can be effectively attenuated.

It is only required that at least one vibration damper 5-6 is bonded to the curved part 5-1. Any number of vibration dampers 5-6 may be arranged.

Although FIG. 4(*a*) illustrates the vibration damper 5-6 having a rectangular shape in plan view as an example, the vibration damper 5-6 may have any shape in plan view. Furthermore, the vibration damper 5-6 may have any thickness. Although the bonded sheet-like vibration damper 5-6 has been described as an example with reference to FIG. 4, the vibration damper 5-6 may be formed by applying vibration-damping paint. The vibration-damping paint may be water-based or oil-based and preferably contains, for example, silicone resin to provide a smooth coating surface. The paint containing silicone resin enables a coating to have a smooth surface. Similarly, the sheet-like vibration damper 5-6 may be made of a mixture containing a silicone-based material to have a smooth surface.

(Second Example of Second Measure)

Figure 5:
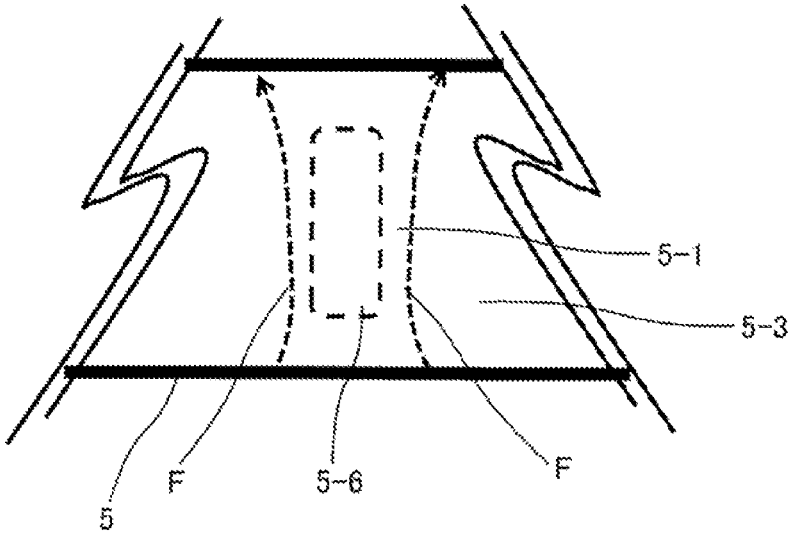
FIG. 5 includes diagrams explaining another example of the second measure to reduce or eliminate vibration of the bell mouth in the air-conditioning apparatus according to Embodiment of the present invention.
Figure 5:
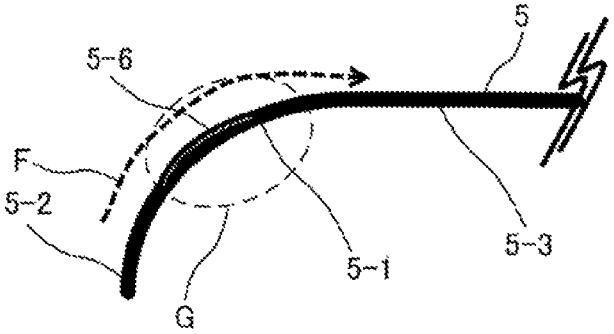
Figure 5:
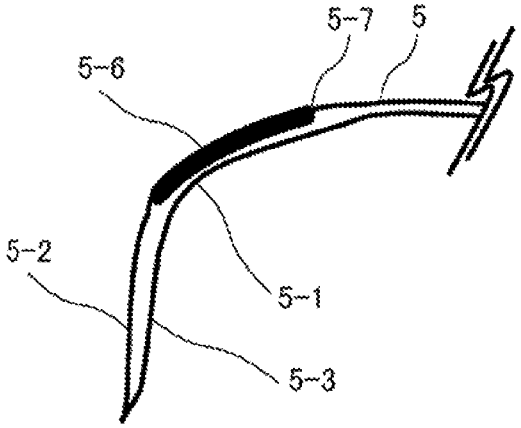

FIG. 5 includes diagrams explaining another or second example of the second measure to reduce or eliminate vibration of the bell mouth 5 in the air-conditioning apparatus 100. Although the vibration damper 5-6 bonded or applied to the bell-mouth rear surface 5-3 has been described as an example with reference to FIG. 4, FIG. 5 illustrates the vibration damper 5-6 bonded or applied to the bell-mouth front surface 5-2. FIG. 5 illustrates the "curved part 5-1", the "bell-mouth front surface 5-2", and the "bell-mouth rear surface 5-3", as in FIG. 4. In FIG. 5, arrows F represent flow of a fluid (air), as in FIG. 4. FIG. 5(*a*) schematically illustrates the bell-mouth rear surface 5-3 of the curved part 5-1, FIG. 5(*b*) schematically illustrates a section of the curved part 5-1 of the bell mouth 5, and FIG. 5(*c*) is a schematic enlarged view of part G in FIG. 5(*b*).

As illustrated in FIG. 5, in the second example of the second measure, the sheet-like vibration damper 5-6, serving as a vibration-damping element, is bonded to the bell-mouth front surface 5-2 of the bell mouth 5. The vibration damper 5-6 is as described with reference to FIG. 4. In addition, the recess 5-7 is also as described with reference to FIG. 4.

Consequently, the bell-mouth front surface 5-2 has no protrusion, such as a rib, so that the fluid flowing on the bell mouth 5 is not obstructed. Vibration in the divided vibration mode in the curved part 5-1 of the bell mouth 5 can be effectively attenuated.

It is only required that at least one vibration damper 5-6 is bonded to the curved part 5-1. Any number of vibration dampers 5-6 may be arranged.

Although FIG. 5(*a*) illustrates the vibration damper 5-6 having a rectangular shape in plan view as an example, the vibration damper 5-6 may have any shape in plan view. Furthermore, the vibration damper 5-6 may have any thickness.

Although the vibration damper 5-6 bonded or applied to either one of the bell-mouth front surface 5-2 and the bell-mouth rear surface 5-3 of the bell mouth 5 is illustrated as an example in FIGS. 4 and 5, the vibration damper 5-6 may be bonded or applied to each of the bell-mouth front surface 5-2 and the bell-mouth rear surface 5-3 of the bell mouth 5. In such a case, the number of vibration dampers 5-6 bonded or applied to the bell-mouth front surface 5-2 does not have to be equal to the number of vibration dampers 5-6 bonded or applied to the bell-mouth rear surface 5-3. The vibration dampers 5-6 may be bonded or applied to the bell-mouth front surface 5-2 and the bell-mouth rear surface 5-3 in such a manner that the vibration dampers 5-6 on the bell-mouth front surface 5-2 are not aligned with those on the bell-mouth rear surface 5-3.

(Example of Third Measure)

An example of the third measure is to form a material containing a vibration-damping material into the bell mouth 5 and thus damp vibration of the bell mouth 5 by using the material. The material for the bell mouth 5 is a mixture containing carbon, which can exhibit vibration-damping performance, or any of polyester-based resins, which tend to thermally expand, and further containing a proper amount of resin to be originally used to make the bell mouth 5. The bell mouth 5 made of such a material allows vibration of the bell mouth 5 to be transformed into heat, thus reducing or eliminating the vibration.

Furthermore, mixing a silicone-based material into the above-described material enables the surfaces of the bell mouth 5 to remain smooth.

The vibration-damping material is preferably mixed into the resin to be originally used to make the bell mouth 5. The vibration-damping material is preferably mixed by up to approximately 50% of the total amount of the mixture in consideration of the fluidity of the mixture containing the vibration-damping material in a "mold" for molding the bell mouth 5.

As the thickness of the bell mouth 5 itself achieves reduction or elimination of vibration, the bell mouth 5 is advantageously allowed to have a smaller thickness than those in the related art. For example, related-art bell mouths require a thickness of approximately 3 mm. In contrast, the bell mouth 5 having a thickness up to approximately 1.5 mm can offer advantages similar to those in the related art.

The whole of the bell mouth 5 may be molded out of a resin mixture containing a vibration-damping material (polymer). Part of the bell mouth 5 may be molded out of this mixture. When part of the bell mouth 5 is molded out of the resin mixture containing the vibration-damping material (polymer), insert molding and traditional resin can be used to make the bell mouth 5.

<Advantages Offered by Air-Conditioning Apparatus 100>

Figure 6:
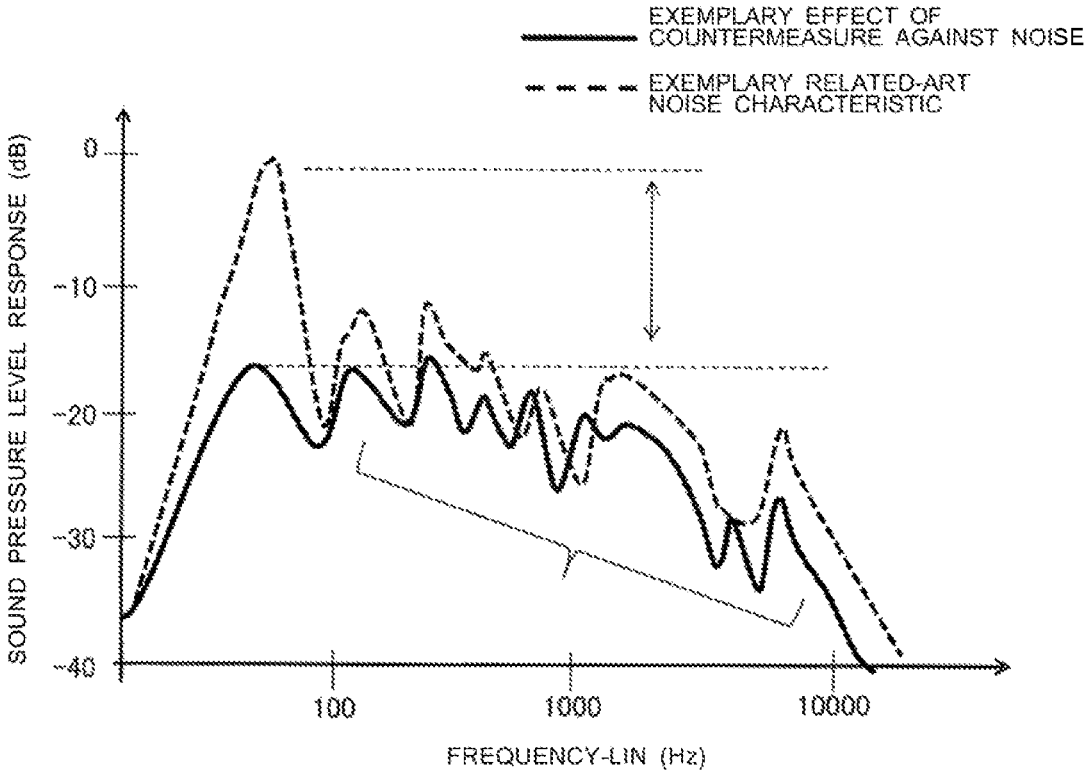
FIG. 6 is a graph explaining an effect of reducing peak frequencies of vibration-induced sound, the effect being obtained by subjecting the bell mouth of the air-conditioning apparatus according to Embodiment of the present invention to any of the first to third measures.

The air-conditioning apparatus 100 has an effect of reducing peak frequencies of vibration-induced sound. This effect will be described below with reference to FIG. 6. FIG. 6 is a graph explaining the effect of reducing peak frequencies of vibration-induced sound, and the effect is obtained by subjecting the bell mouth 5 of the air-conditioning apparatus 100 to any of the first to third measures. In FIG. 6, a full line represents the frequency characteristic of vibration-induced sound in the air-conditioning apparatus 100 and a dotted line represents the frequency characteristic of vibration-induced sound in a bell mouth subjected to none of the first to third measures. In FIG. 6, the horizontal axis represents the frequency and the vertical axis represents the sound pressure level.

The air-conditioning apparatus 100 includes the fan 6 as a component and the air passage 50 is defined by the foam material 10. In such a configuration, the foam material 10 may be vibrated by the fluid and thus generate "vibration". The foam material 10 may resonate with vibration associated with rotation of the motor 7 and the fan 6, propagate the vibration through the structure, and thus generate "vibration". The "vibration" generated by the foam material 10 may be propagated to the components constituting the air-conditioning apparatus 100, for example, the bell mouth 5. In other words, rotation of the fan 6 generates NZ sound, resulting in vibration of the bell mouth 5.

As represented by the dotted line in FIG. 6, the frequency characteristic of the bell mouth subjected to none of the first to third measures tends to have a high peak frequency in a frequency band of 100 Hz or lower.

In contrast, as the air-conditioning apparatus 100 includes the bell mouth 5 subjected to any of the first to third measures, as represented by the full line in FIG. 6, peak frequencies are reduced by 5 dB or more in a wide frequency band.

As described above, as the air-conditioning apparatus 100 includes the bell mouth 5 subjected to any of the first to third measures, the air-conditioning apparatus 100 ensures a reduction in vibration-induced sound resulting from NZ sound associated with rotation of the fan 6. In addition, the bell mouth 5 subjected to any of the first to third measures does not obstruct air flow through the air-conditioning apparatus 100.

Although the first to third measures have been described as individual countermeasures against vibration of the bell mouth 5 in Embodiment, the bell mouth 5 may be made by using a combination of these measures. Furthermore, the third measure is intended to be used together with at least one of the first and second measures.

REFERENCE SIGNS LIST

1 housing 2 side 3 top 4 front panel 4*a* air inlet 4*b* air outlet 5 bell mouth 5-1 curved part 5-2 bell-mouth front surface 5-3 bell-mouth rear surface 5-5 rib 5-6 vibration damper 5-7 recess 5X bell mouth 5X-1 curved part 5X-2 bell-mouth front surface 5X-3 bell-mouth rear surface 6 fan 7 motor 8 support rubber 9 heat exchanger 10 foam material 50 air passage 100 air-conditioning apparatus

The invention claimed is:

1. An air-conditioning apparatus, comprising:

a housing having an air inlet and an air outlet;

a fan disposed in the housing; and a bell mouth through which a fluid flowing from the air inlet to the air outlet passes in association with rotation of the fan, the bell mouth including a curved part having a curved sectional shape in a fluid flow direction and a vibration-damping element disposed on at least one of a front surface and a rear surface of the curved part, the vibration-damping element being disposed at a position corresponding to a node of vibration of the bell mouth, the vibration-damping element including a vibration-damping element formed as a rib having a rounded tip having an angle of 100 degrees or more.

2. The air-conditioning apparatus of claim 1, wherein the rib has a rhombus shape in plan view, the rhombus shape having a longitudinal length in the fluid flow direction.

3. The air-conditioning apparatus of claim 1, wherein the rib is made of a material capable of transforming vibration into heat.

4. The air-conditioning apparatus of claim 1, wherein all or part of the bell mouth contains vibration-damping resin.

5. The air-conditioning apparatus of claim 1, further comprising a foam material disposed at an interior of a side and a top of the housing.

* * * * *